United States Patent [19]

Anell

[11] 4,129,286

[45] Dec. 12, 1978

[54] LIFTING JACK FOR VEHICLES

[75] Inventor: Wolfgang Anell, Zerf, Fed. Rep. of Germany

[73] Assignee: Firma August Bilstein, Wuppertal-Barmen, Fed. Rep. of Germany

[21] Appl. No.: 765,124

[22] Filed: Feb. 3, 1977

[30] Foreign Application Priority Data

Feb. 11, 1976 [DE] Fed. Rep. of Germany ... 7603865[U]
Oct. 25, 1976 [DE] Fed. Rep. of Germany ..... 2648196

[51] Int. Cl.[2] ..... B66F 3/18
[52] U.S. Cl. ..... 254/103
[58] Field of Search ..... 254/98–103; 74/89.15, 424.8 R

[56] References Cited

U.S. PATENT DOCUMENTS 3,927,864 12/1975 Meierkort et al. ..... 254/103

*Primary Examiner*—Robert C. Watson
*Attorney, Agent, or Firm*—Neuman, Williams, Anderson & Olson

[57] ABSTRACT

A vehicle lifting jack has a hollow support leg with a slot extending axially along one side thereof, and a load bearing member is slidably mounted within the leg and projects through the axial slot. The load bearing member is displaced vertically by rotation of a threaded spindle that is driven by a driving pinion and a gear wheel meshed therewith. The gear wheel is associated with an axial bearing that engages a bearing plate, and the bearing plate is mounted at the upper end of the support leg by engagement between projections of the bearing plate and an upwardly open depression at, and a transverse slot near, the top of the support leg.

6 Claims, 12 Drawing Figures

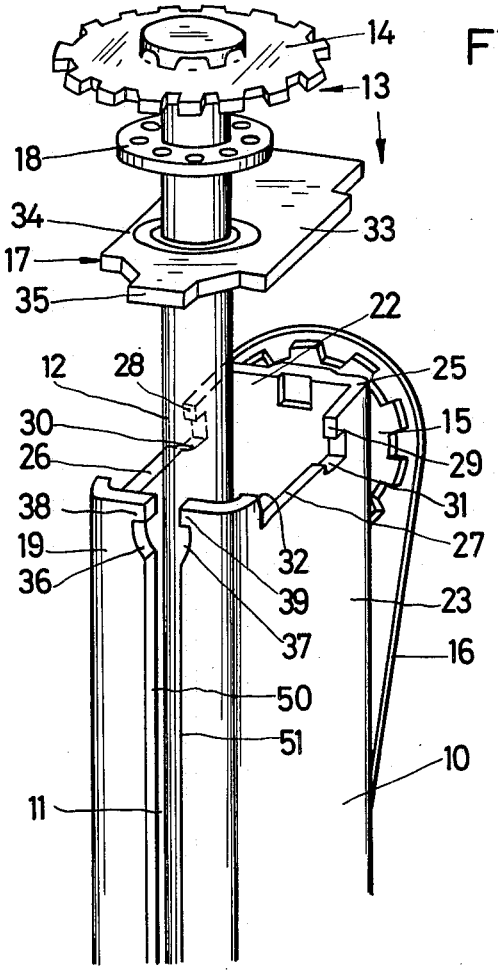
Fig.1
Fig.3
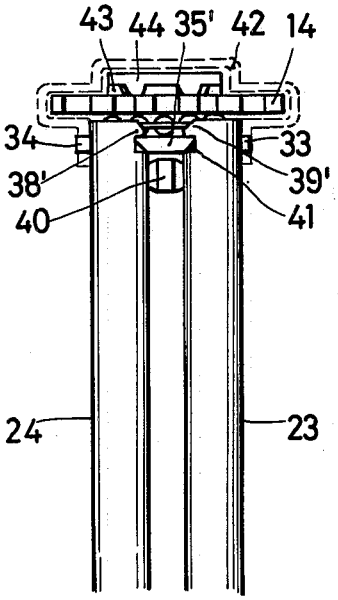
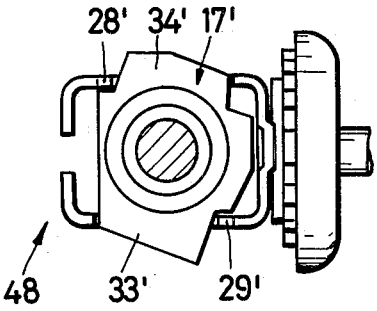
Fig.4
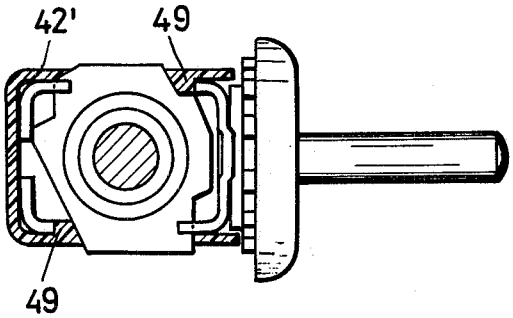
Fig.5

LIFTING JACK FOR VEHICLES

The invention relates to a lead screw lifting jack for vehicles, wherein the lead screw gearing is mounted upon a bearing plate at the upper end of the support leg.

A vehicle lifting jack is known wherein the bearing plate is arranged at the top edge of the support leg and welded thereto. For this vehicle jack it is not possible to adopt a low production cost process of dip lacquering in the case where the lead screw spindle, a spindle gear wheel, an axial bearing and the bearing plate form a structural unit, because the lacquer deposit upon the lead screw spindle and axial bearing would cause stiff working of these parts.

In contrast thereto, the present invention takes as its basic purpose the provision of a vehicle lifting jack having a structural unit comprising the lead screw spindle, the spindle gear wheel, axial bearing and bearing plate, which lifting jack can be lacquered by the dipping process without resulting in stiff running of the working parts, and wherein the support leg of small dimensions, in particular where the support leg has a narrow slot, is able to offer high resistance against stresses imposed upon a load bearing point of the jack.

This problem is solved in that the end of the support leg is provided with an upwardly open depression, in which the bearing plate is freely engageable.

It is of importance for the invention that the design of the support leg, that is to say its cross section and its dimensions, are independent of the design of the lead screw gearing, but at the same time so as to ensure a simple assembly of the gearing, or the structural unit, with the support leg, without resulting in any permanent deformation of the engaging parts and without the performance of any welding or the like operations which would damage the parts which have already been lacquered. In the performance of the invention two diagonally opposite transverse slots are provided in the support leg, and in each case a horizontal projection is provided situated above and overhanging the transverse slot, and the bearing plate is provided with projections so that the bearing plate can be assembled to the support leg from above by bringing said projections underneath the horizontal projections to produce an axially rigid assembly. The bearing plate can easily be lowered from above to bring one or both of its projections to lie in the transverse slots and underneath the horizontal projections of the support leg, so that the position of the bearing plate is fixed not only in the radial direction but also in the axial direction.

It is also of importance for the invention that the transverse slots in the support leg are arranged at a distance below the upper edge of the support leg which is less than the vertical height of the axial bearing. By this means the result is not only achieved that the necessary tilting of the bearing plate when installing it in the support leg need only be small, but also that the design of the lead screw gearing above the support leg, in particular the diameter of the lead screw gear wheel, can be independent of the dimensioning of the cross section of the support leg. For example a large transmission ratio of the lead screw gearing may be obtained.

Such vehicle lifting jacks are employed for power driven vehicles, for example when changing a wheel. If the tyre of the wheel is flat, then the chassis of the power driven vehicle sinks to a position which is a minimum distance from the ground. Consequently the load bearing point of the jack must likewise be lowered by the lead screw spindle to make possible the satisfactory setting of the vehicle lifting jack. In this situation it may happen that the person who is operating the jack will crank the load bearing support of the jack so far down that it reaches the lowest point limited by the foot at the end of the support leg, and therefore strikes the latter during its downward movement. This impact results in a reaction force which tends to drive the lead screw spindle upwards. As a result of this the bearing of the lead screw spindle at the upper end of the support leg suffers an impact.

It is therefore important to design the vehicle jack in such a manner that any disturbance or damage to the bearing of the lead screw spindle shall be avoided, in particular when setting the load bearing member of the jack in its lowest position.

This effect is achieved in that the vertically adjustable load bearing member, at least when it is in its lowest position, is brought out of engagement with the thread of the lead screw spindle, but is urged in the direction of engagement by a spring element. In consquence the hand crank can be further rotated after the setting of the load bearing member, without this resulting in any substantial transmission of reaction force through the lead screw spindle to its upper bearing. On the other hand, it is necessary only to rotate the hand crank in the opposite direction in order to reengage the load bearing member with the lead screw thread, so that upon further operation of the hand crank lifting of the load bearing member, and of the load supported thereon, takes place.

In the accompanying drawing

FIGS. 1 and 2 show in perspective and side elevation respectively the upper region of a first practical form of a vehicle jack;

FIG. 3 is a front view of a second practical form;

FIGS. 4 and 5 are plan views on the bearing plate of a third practical form;

Figure 2:
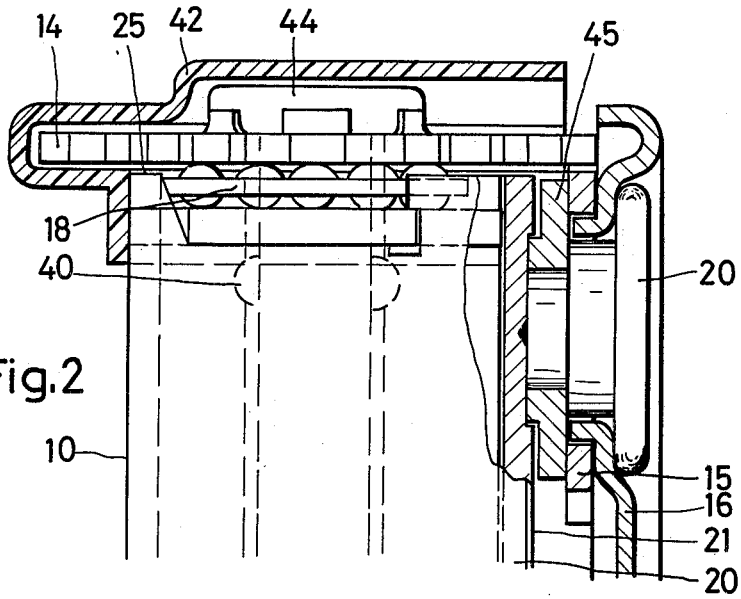

The lead screw vehicle jack according to FIG. 1 has a support leg 10 having a comparatively narrow slot 11 for the lifting arm, which is not shown in this figure of the drawing. This lifting arm is secured to a lead screw nut, also not shown, and situated within the support leg 10, the lifting arm projecting outwardly through the slot 11 bounded by the edges 50, 51 of the support leg. The lead screw nut is non-rotatably guided in the support leg and is vertically displaceable by the lead screw spindle 12 by the rotation of the latter. This function is performed by the lead screw gearing 13 comprising the lead screw gear wheel 14 and the driving pinion 15. The lead screw gear wheel 14 is immovably secured to the spindle 12 and the driving pinion 15 is rotatable by the hand crank 16. The gear wheel 14 supports itself upon the axial bearing 18, which itself bears upon the bearing plate 17, mounted upon the end 19 of the support leg. The driving pinion 15 is carried in the bearing bush 20, which is secured to the outer surface 21 of the rear wall 22. The side walls 23, 24 have transverse slots 26, 27 provided immediately below the upper edge 25 of the support leg. The transverse slots are open at the upper end of the support leg. The slots are also overhung at the end nearest the rear wall by horizontal projections 28, 29, below which there are provided cavities 30, 31 respectively. The boundary edges 32 of the slots remote from the horizontal projections are inclined upwardly and outwardly.

The bearing plate 17 shown in FIG. 1 has extensions 33, 34 which fit into the transverse slots 26, 27 as shown in FIG. 2. Thereby the horizontal extensions 28, 29 engage over the ends of the flange shaped extensions 33, 34. Moreover there is provided a position locking extension 35, which is arranged to engage in the transverse slot 36, 37 and to be rigidly locked therein in the axial direction by the horizontal projections 38, 39.

The support leg component group includes the lead screw spindle 12, the lead screw gear wheel 14, the axial bearing 18 and the bearing plate 17 forming a structural unit, these parts being held together by deformations 40 or the like in the lead screw spindle, as in FIG. 2, the assembly of these to the support leg being effected, firstly by passing the lead screw spindle from above into the support leg, and thereafter presenting the bearing plate 17 so that its extensions 33, 34 pass underneath the horizontal projections 28, 29 and into the cavities 30, 31, for which purpose sufficient clearance must be available between the bearing plate 17 and the lead screw spindle 12 to allow for the necessary tilting. Thereafter, by means of a tool inserted in the slot 11, the side walls 23, 24 are forced apart so that the position locking projection 35 can be passed from above into the transverse slot 36, 37 underneath the horizontal projections 38, 39, whereby the bearing plate 17 is rigidly locked in the axial direction to the support leg. It is also possible, however, as shown in FIG. 3, to provide a position locking projection 35' with downwardly directed inclined faces 41, and to shape the horizontal projections 38', 39' accordingly so that the bearing plate, after being tilted for insertion into the transverse slots 26, 27, can be snapped into the position shown in FIG. 3 by applying pressure upon the bearing plate. FIG. 3 makes clear that the extensions 33, 34 project so far over the side walls 23, 24 that these extensions can be employed for retaining the top cap 42. The latter is pushed into its final position from the front after the fitting of the bearing plate 17, and the top cap also clamps around the position locking projection 35 or 35'.

From FIG. 3 may be seen that no axial forces can be transmitted onto the top cap 42, this effect being achieved on the one hand by providing pinch deformations 40 in the lead screw spindle at one side of the lead screw gearing and, on the other hand, the head piece 44 which is force fitted between the upstanding lugs 43 provided on the lead screw gear wheel 14, together with the described means for the positive axial locking of the position of the bearing plate.

In FIG. 2 it is clearly seen that the transverse slots are arranged at a distance below the upper edge 25 of the support leg which is less than the vertical height of the axial bearing 18. The lead screw gear wheel 14 can therefore be designed independently of the dimensions of the support leg 10, in particular it may be designed with a comparatively large diameter in order to provide a high transmission ratio. The spacing disc 45, preferably provided with lubrication channels, and positioned between the driving pinion 15 and the rear wall 22 of the support leg, not only retains the driving pinion at the necessary distance, determined by the lead screw gear wheel, for satisfactory engagement, but also provides at the same time trouble-free guidance for the driving pinion so as to counteract tilting influences and to stabilise the meshing of the gear wheels. In the region of the bearing bush 20 the driving pinion is provided with recesses, in which engage splines which are formed in the hand crank 16.

According to FIG. 4 the horizontal projections 28', 29' of the transverse slots are arranged in mutually diagonal relationship so that only the horizontal projection 29' is adjacent the rear wall of the support leg whilst the horizontal projection 28' is adjacent the front side of the vehicle jack. The extensions 33', 34' of the bearing plate 17' are so formed that upon insertion of the lead screw spindle or the structural unit, these extensions can be passed into the open transverse slots without any tilting action occuring. Thereafter the bearing plate 17 is twisted to the left into the position shown in FIG. 5 so that the extension 34' engages underneath the horizontal projection 28' and the extension 33' engages under the horizontal projection 29'. In this final installation position, the locking of the bearing plate is effected by the top cap 42', which for this purpose is provided with projections 49 engaging in the transverse slots. The stress applied to the top cap 42' by any forces resulting from operation of the vehicle jack is very small, because the only forces which can have any effect upon the top cap are those resulting from the bearing friction of the axial bearing 18, and still in a direction which will not result in any immediate spreading apart of the side members of the top cap.

Figure 6:
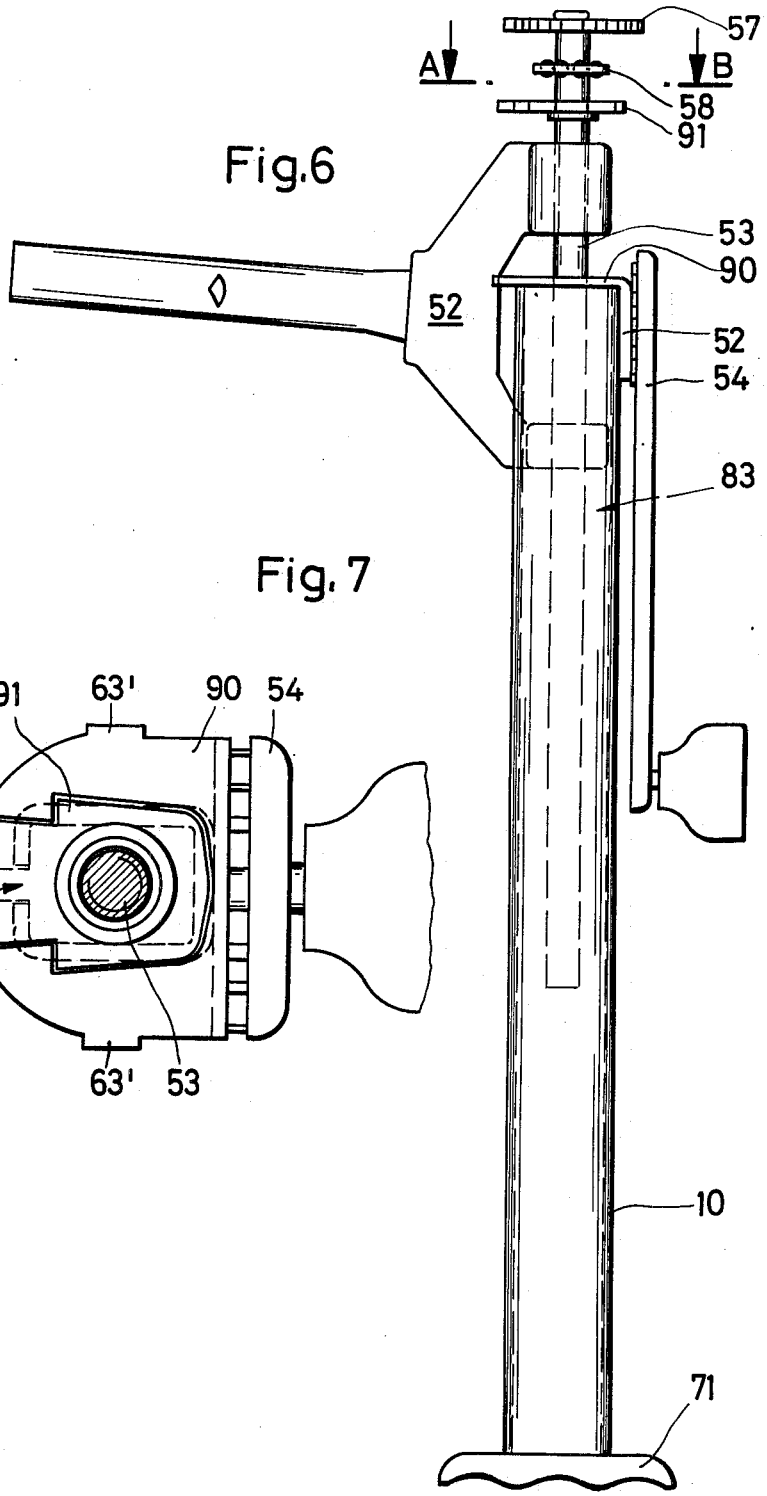
FIGS. 6 and 7 show a fourth practical form of a vehicle jack, the views being an elevation with the components of the upper portion separated, and a cross-sectional view respectively.
Figure 7:
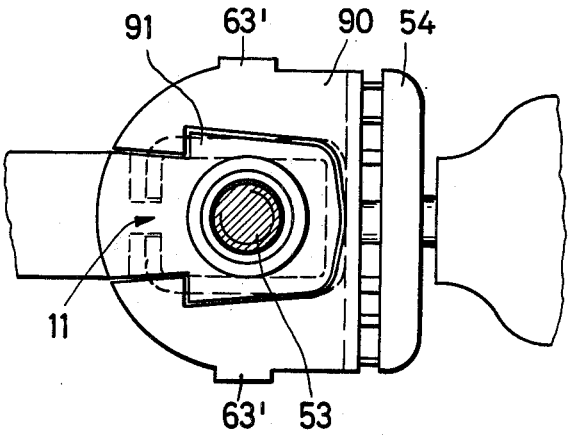

In the vehicle jack according to FIGS. 6 and 7 a plate member 90 is applied to the upper end of the support leg 10 and is secured thereto, for example by welding. This plate is provided with recesses, or projections 63', about which a top cap, not shown in the drawing, is intended to be clamped, and the plate also has an angle flange 52 extending parallel to the rear wall of the support leg 10, which flange together with the rear wall of the support leg carries the bearing stud required for rotatably supporting the driving pinion 56 and the hand crank 54. The plate member 90 leaves the clear space 83 inside the support leg 10 so that the load bearing member 52 with its fork ends may have the necessary cross section.

The outer periphery of the bearing plate 91 corresponds in shape to the internal margin of the plate member 90 and bears upon parts of the edges of the upper end of the support leg 10. The bearing plate 91 is positively locked in the lateral direction by reason of its outer edges being retained within the inner edges of the plate member 90, which, together with the end of the support leg, forms a depression within which lies the bearing plate.

Figure 9:
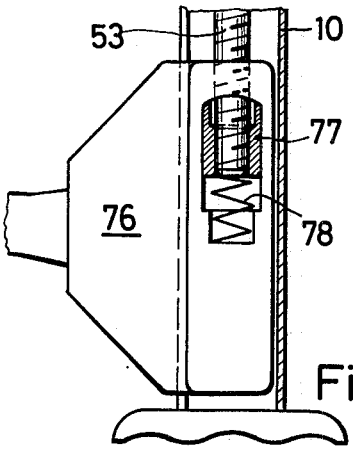
FIGS. 8 to 10 show practical forms of vehicle jacks with protection against overcranking.
Figure 10:
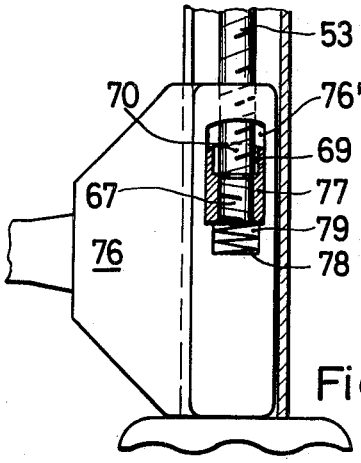

The assembly of the vehicle jack is effected by introducing the load bearing member 52 and the lead screw spindle 53 from above into the support leg 10, which is provided at its bottom end with a foot 71, whereafter the bearing plate 91 can be laid upon the upper end of the support leg 10 freely between the inner edges of the plate member 90. The lead screw gear wheel 57 and the bearing 58 are held together by a top cap clamping round the projections 23' in a manner analogous to that of FIG. 3. In particular, in the type of vehicle jack, wherein the bearing plate is not rigidly secured to the support leg in the axial direction, the provision of an overcranking protection device is of advantage, such as is shown in FIGS. 8 to 10.

The lead screw spindle is rotated by the hand crank 54, which is coupled thereto through a spur wheel gear 55. The driving pinion 56 of this spur wheel gear is connected to the hand crank 54, whilst the spindle gear wheel 57 driven by said driving pinion rests upon a bearing 58, lying upon a bearing plate 59 designed analogous to that in FIG. 7, which is supported upon the upper end 60 of the support leg. Moreover the spindle gear wheel 57 is rigidly connected to the lead screw spindle so that rotation of the spindle gear wheel is transmitted to the lead screw spindle. The spindle gear wheel 57 is enclosed by a cap 61, which is connected to the support leg 10 directly or through the bearing plate 59, for example this connection is effected by way of bent lugs 62 which clamp around the projections 64 of the bearing plate. The top cap 61 ensures the axial stability of the gearing upon the upper end of the support leg by protecting it against movements of the lead screw spindle in the upward direction.

Figure 8:
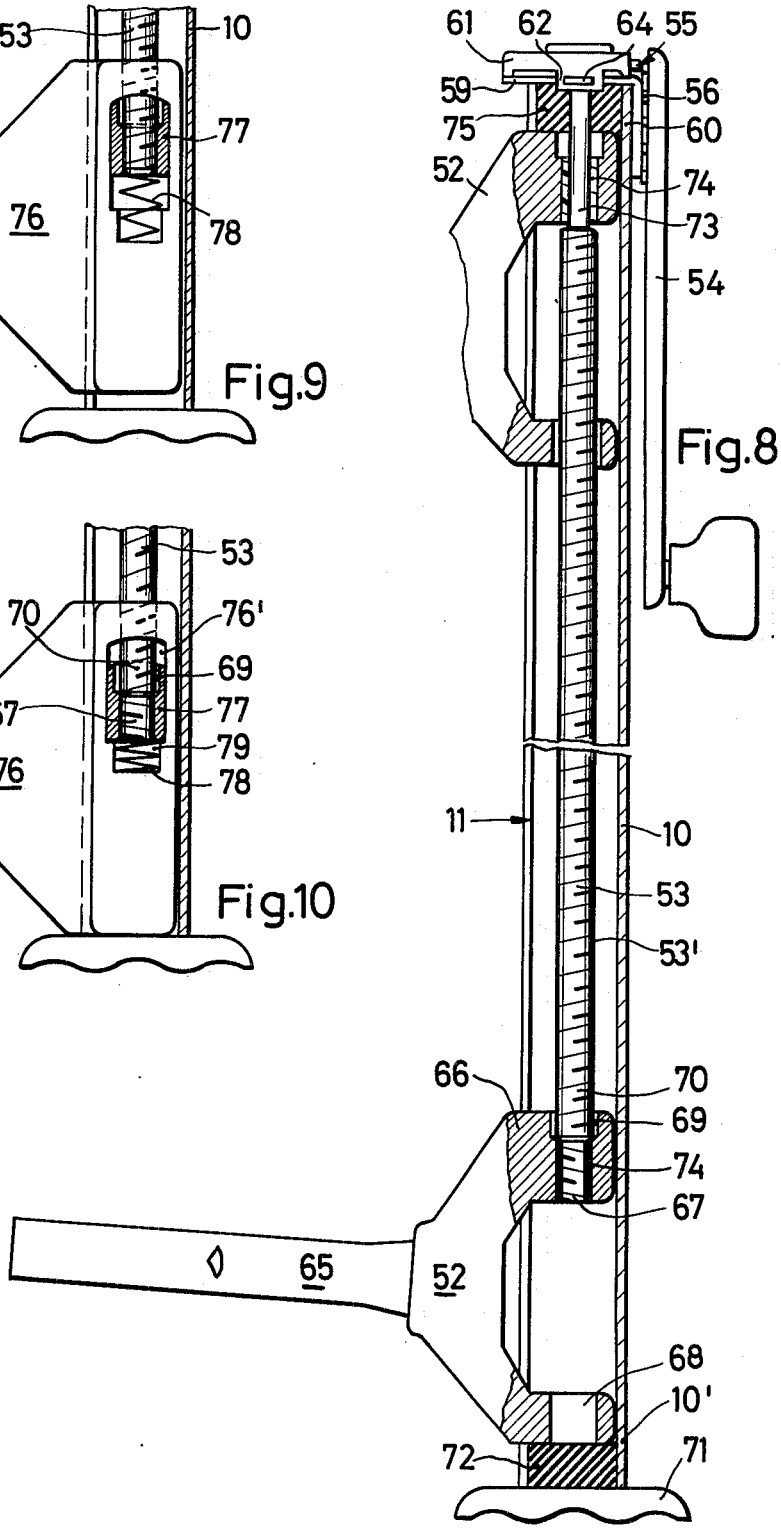

The load support member 52 in FIG. 8 is provided with a lifting arm 65 connected to it and having limited movement upwardly and downwardly. The load bearing member 52 is of forked design, and its upper fork end 66 is provided with a tapped bore for engagement with a spindle lead screw 53'. In the lower fork end there is provided a guide bore 68. The tapped bore 67 has its upper region enlarged to form a spindle clearance bore 69, which surrounds the lower end 70 of the lead screw spindle 53 when the load bearing member 52 is in the lower position shown in the drawing. In this case the radial stability is ensured between the lead screw spindle and the load bearing member 52 guided in the support leg 53, and this is so even when the tapped bore is not in engagement with the spindle thread 53'.

Underneath the load bearing member 52 and the lower end 10' of the support leg 10 there is a resilient element 72 in the form of a rubber buffer, here shown in its compressed condition. This rubber buffer urges the load carrying member into the direction of engagement with the lead screw spindle so that the tapped bore immediately comes into engagement with the spindle thread 53' when the hand crank 54 is rotated in the appropriate direction.

According to FIG. 8 at the upper end of the lead screw spindle there is provided a plain shaft 73, which is surrounded by the thread 74 of the tapped bore 67. Also in this uppermost position of the load bearing member 52 it is possible for the hand crank 54 to be rotated without resulting in any further motion of the load bearing member 52, which would stress the upper bearing of the lead screw spindle. The resilient element 75 in the form of a rubber buffer urges the load bearing member 52 into the direction of engagement with the lead screw spindle 53 so that upon rotation of the hand crank 54 in the appropriate direction the bore threads 74 and the spindle threads 53' again engage.

Whilst the load bearing member 52 in FIG. 8 may consist, for example, of a casting, the load bearing member 76 is of a design particularly suitable for fabrication from metal punchings. In this case there is provided a lead screw nut 77 enclosed by the load bearing member 76, the nut being arranged for limited movement within the load bearing member in the direction of displacement of the latter. In the position of the load bearing member 76 shown in FIG. 9 adjacent the lower end of the support leg 10, the lead screw spindle 53 supports the lead screw nut 77, upon which is suspended the load bearing member 76. If the lead screw spindle 53 is so rotated that the load bearing member 76 is brought into the lowest position shown in FIG. 10, then upon a further rotation of the hand crank in the same direction the lead screw nut 77 descends into the position shown in FIG. 10 wherein it compresses the resilient element 78. Shortly before the point of maximum possible compression of the resilient element 78, the threaded end of the lead screw spindle 53 disengages from the threads of the tapped bore 67 without the possibility of substantial reaction forces being transmitted from the lead screw spindle 53 to its upper bearing. The axial forces exerted by the compression of the resilient element 78 can be quite easily absorbed by a top cap 61 designed, for example, in accordance with FIG. 8. These forces are substantially smaller than those which would be produced by overcranking of the hand crank in conventional designs of vehicle jack. Apart from this the force of the spring 78 can be precisely determined because a compression space 79 is provided, the upper edges of which constitute a stop for the lead screw nut 77.

In both of the practical forms of the invention it is ensured that the thread 53' of the lead screw disengages from the threaded bore 74. This effect is achieved by suitable length dimensioning of the lead screw spindle and of the thread thereof in the upper region of the lead screw spindle. As compared with conventional vehicle jacks, the lead screw spindle can be designed to be shorter by the length of the tapped bore.

Figure 11:
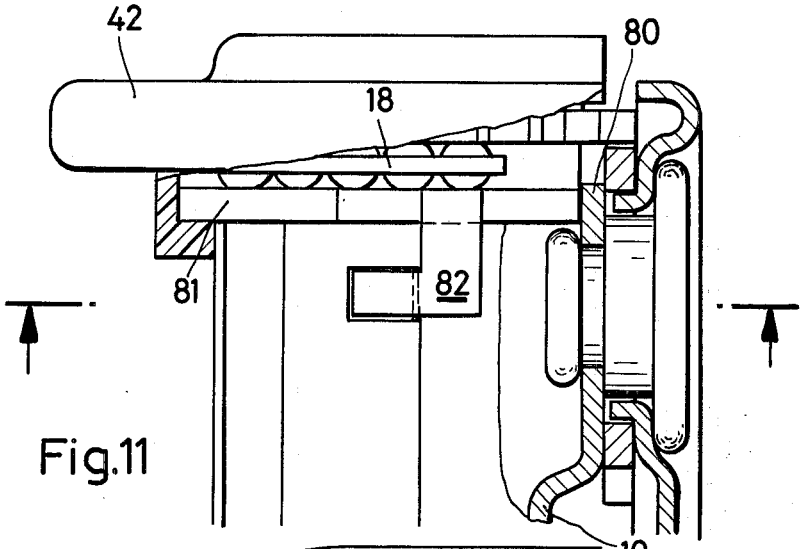
FIGS. 11 and 12 show a side view and a cross-section of a fifth practical form.
Figure 12:
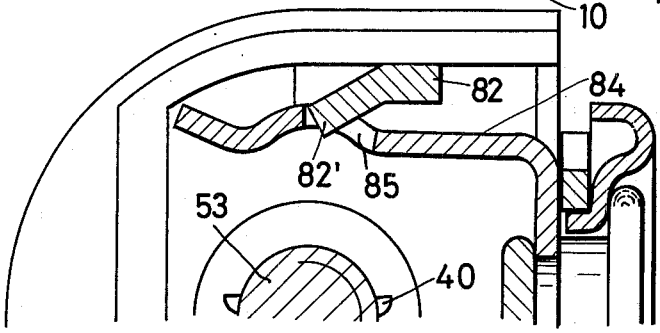

In the vehicle jack represented in FIG. 11 the upwardly open depression in the end of the support leg is formed by a foreshortening of the support leg so that all that remains is the projecting part 80 in the rear wall of the support leg. This projection forms a stop for the bearing plate 81, which is provided with two retaining lugs projecting axially downward, which are arranged laterally with respect to the side walls 84 of the U-shaped support leg, which walls are parallel to the lifting arm. In these walls there are provided upwardly closed slots 85, in which engage the ends 82' of the lugs, which are offset for this purpose. The ends of the lugs lock the position of the bearing plate 81 at the end of the support leg to oppose any stresses applied through the lead screw spindle 53, which is provided with the deformations 40, which bear against the bearing plate 81 as a result of any axially directed impact upon the lead screw spindle.

I claim:

1. A lifting jack for vehicles, comprising an axially slotted support leg, a load bearing member projecting outwardly from said support leg, a rotatable screw-threaded spindle, means mounting the load bearing member for nonrotatable movement along the length of said support leg in response to rotation of said spindle; means for transmitting rotary movement to said spindle mounted at an upper end of said support leg; the transmitting means comprising a driving pinion and gear means meshing therewith; said support leg having upwardly extending distal edges disposed adjacent said gear means; said gear means being rigidly secured to said spindle for rotatable movement therewith; a bearing for supporting said gear means engaging the undersurface thereof; a bearing plate supporting said bearing; portions of said distal edges of said support leg being slotted so as to define supporting edge surfaces on which said bearing plate is received; means locking said bearing plate to said support leg, said support edge surfaces supporting said bearing plate below said distal edges a distance which is less than the thickness of said bearing extending between said bearing plate and said gear means whereby said gear means is spaced from said support leg upper end and may rotate exteriorly of said support leg.

2. The lifting jack of claim 1 in which said means locking said bearing plate to said support leg comprises portions of said support leg overlying said supporting edge surfaces for said bearing plate.

3. A lifting jack according to claim 1, further comprising a spacing disc mounted upon a bearing bush carrying a driving pinion rotatably arranged upon said support leg, said spacing disc being located between the support leg and the driving pinion.

4. A lifting jack according to claim 1, wherein said gear wheel means is provided at the side facing said screw-threaded spindle with raised splines between which is force fitted the upper end of said spindle.

5. A lifting jack for vehicles comprising a support leg having an axially extending slot; a load bearing member projecting outwardly from said support leg through said support leg slot; a screw-threaded spindle rotatably mounted within said support leg; means mounting the load bearing member for nonrotatable movement along the length of said support leg in response to rotation of said spindle; means for transmitting rotary movement to said spindle mounted at an upper end of said support leg defined by leg distal edges; the transmitting means comprising a driving pinion and gear means meshing therewith; said gear means being rigidly secured to said spindle; a bearing supporting said gear means and facilitating rotary movement thereof; a bearing plate supporting said bearing; distal edge portions of said support leg being slotted and defining exterior-facing, supporting edge surfaces for engaging said support plate; said supporting edge surfaces being located adjacent the periphery of said spindle whereby load forces tending to bend said support plate relative to said support leg are efficiently resisted; said gear means being spaced from said support leg distal edge portions and rotatable exteriorly of said support leg.

6. The lifting jack of claim 5 in which said spindle is of a diameter larger than the width of said axially extending slot of said support leg and is receivable in said support leg through the distal end thereof whereby said spindle, gear means, bearing and bearing plate are received in said support leg interior in assembled relation and supportably mounted on said support edge surfaces.

* * * * *